US008147653B2

(12) United States Patent
Stone et al.

(10) Patent No.: US 8,147,653 B2
(45) Date of Patent: Apr. 3, 2012

(54) HIGH FIBER SUPPORT INTRINSIC WARP-TIED COMPOSITE FORMING FABRIC

(75) Inventors: Richard Stone, Carleton Place (CA); Roger Danby, Arnprior (CA)

(73) Assignee: AstenJohnson, Inc.

( * ) Notice: Subject to any disclaimer, the term of this patent is extended or adjusted under 35 U.S.C. 154(b) by 0 days.

(21) Appl. No.: 12/997,189

(22) PCT Filed: Jun. 9, 2009

(86) PCT No.: PCT/CA2009/000807

§ 371 (c)(1), (2), (4) Date: Feb. 2, 2011

(87) PCT Pub. No.: WO2009/149548

PCT Pub. Date: Dec. 17, 2009

(65) Prior Publication Data

US 2011/0114278 A1 May 19, 2011

(30) Foreign Application Priority Data

Jun. 9, 2008 (CA) ..... 2634432

(51) Int. Cl.
*D21F 1/10* (2006.01)

(52) U.S. Cl. ..... 162/348; 162/289; 139/383 A; 139/425 A

(58) Field of Classification Search ..... 162/348, 162/902, 903, 289; 139/383 A, 425 A
See application file for complete search history.

(56) References Cited

U.S. PATENT DOCUMENTS 5,169,711 A 12/1992 Bhatt et al.
5,502,120 A 3/1996 Bhatt et al.
5,826,627 A 10/1998 Seabrook et al.
6,202,705 B1 3/2001 Johnson et al.
6,581,645 B1 6/2003 Johnson et al.
7,059,359 B2 6/2006 Quigley et al.
2006/0048840 A1 3/2006 Quigley

FOREIGN PATENT DOCUMENTS

EP 1630283 A1 3/2006

OTHER PUBLICATIONS

International Search Report and Written Opinion dated Sep. 8, 2009 for International Application No. PCT/CA2009/000807, International Filing Date: Jun. 9, 2009 consisting of 10-pages.

Robert L. Beran, "The Evaluation and Selection of Forming Fabrics" Tappi, vol. 62(4):39-44 (Apr. 1979).

*Primary Examiner* — Mark Halpern
(74) *Attorney, Agent, or Firm* — Christopher & Weisberg, P.A.

(57) ABSTRACT

A woven filtration fabric for cellulosic sheet formation. The warp yarns comprise intrinsic binder yarn pairs, and a set of dedicated machine side layer warp yarns. The members of each intrinsic binder yarn pair alternate with each other to define a single combined path in each layer. Whenever a member interweaves with a machine side layer weft yarn, at least one machine side layer warp yarn interweaves with the same weft yarn in the same knuckle. In some embodiments, the members form double knuckles in the machine side layer, firstly together with a first machine side layer warp yarn and then together with a second machine side layer warp yarn. The warp yarn path ratio of machine side layer warp yarns to single combined paths of the intrinsic binder yarn pairs is at least 1.5:1. The fabrics provide increased center plane resistance, resulting in improved drainage and sheet uniformity.

15 Claims, 7 Drawing Sheets

HIGH FIBER SUPPORT INTRINSIC WARP-TIED COMPOSITE FORMING FABRIC

CROSS-REFERENCE TO RELATED APPLICATIONS

This application is a Submission Under 35 U.S.C. §371 for U.S. National Stage Patent Application of International Application Number: PCT/CA2009/000807, filed Jun. 9, 2009 entitled "HIGH FIBER SUPPORT INTRINSIC WARP-TIED COMPOSITE FORMING FABRIC," which claims priority to Canadian Application Serial No. 2,634,432, filed Jun. 9, 2008, the entirety of both which are incorporated herein by reference.

FIELD OF THE INVENTION

This invention relates to woven industrial fabrics for filtration and formation of a cellulosic fibrous sheet, and in particular to papermakers' forming fabrics that provide high fiber support, and improved drainage properties. The invention more particularly relates to an intrinsic warp-tied composite forming fabric in which all the warp yarns of the paper side surface comprise pairs of intrinsic binder yarns arranged so as to bind the paper and machine side fabric structures together, and in which the ratio between the number of machine side warp yarns and the effective number of warp yarn paths in the sheet side is at least 1.5:1.

BACKGROUND OF THE INVENTION

This invention relates to flat woven industrial fabrics generally intended for filtration in sheet formation. However, the invention has particular applicability to papermakers' forming fabrics, and will be discussed primarily below in relation to such fabrics, although it is equally applicable to many industrial filtration uses where fiber support, fabric drainage rates and dimensional stability are important criteria.

In the discussion that follows, the following terms and corresponding abbreviations have the following meanings assigned to them:

Center Plane: a notional plane passing through the center of the fabric parallel to both the paper side (PS) and machine side (MS) of the fabric. In a woven fabric, this plane is occupied in part by the interwoven warp and weft yarns.

Center Plane Resistance (CPR): the resistance within the region of the center plane to the passage of fluid through the fabric. The amount of resistance is proportional to the extent to which the center plane is occupied by warp and weft yarns. The value of CPR for a fabric is calculated in terms of the amount of open area in a fabric, expressed as a percentage of the total area of the plane. Fabrics having relatively lower values of CPR (i.e. less open area available for drainage) will provide greater resistance to fluid flow than fabrics with relatively higher values of CPR (i.e. greater open area available for drainage).

Composite Fabric: a forming fabric comprised of at least two layers of warp and/or weft yarns in which at least one of the set of warp and/or weft yarns forming one surface (typically the paper side) of the fabric is also part of the opposite surface and serves to bind the two layers together to form the composite fabric (an example is Seabrook et al U.S. Pat. No. 5,826,627).

Cross-Machine Direction (CD): a direction perpendicular to the machine direction and in the plane of the fabric layer.

Drainage Area: the amount of open area on the paper side surface of the fabric which is available for fluid drainage and is not occupied by yarns, expressed as a percentage of the entire paper side surface area.

Fiber Support Index (FSI): a measure of the number of points provided by the paper side surface of a forming fabric available to support the papermaking fibers; FSI is calculated using the method described by Robert Beran in *TAPPI J*, Vol. 62, No. 4 (April 1979) p. 42, and discussed further below.

Float: refers to that portion of a component yarn which, in one repeat of the fabric weave, passes over or under a group of other yarns without interweaving with them; the associated term Float Length refers to the length of the float, expressed as the number of paper or machine side layer yarns over which the component yarn passes.

Frame Opening: the substantially rectangular open area between the interwoven warp and weft yarns on the paper side surface of a forming fabric. The related term Frame Length refers to the machine direction length of such an opening. Frame Count is the number of frame openings per unit area on the paper side surface.

Intrinsic Binder Yarn Pairs: two yarns that are woven according to the same apparent pattern in one fabric surface so that one replaces the other in sequence in the chosen weave path on that surface to effectively form a single combined path. Each pair member forms a part of the structure of one surface of a fabric and also passes beneath that surface to form a knuckle around at least one yarn in the layer of opposite surface to bind the two layers together. Intrinsic binder yarn pair members may be warp or weft yarns; in the present invention, they are warp yarns.

Knocking: the number of weft yarns per unit machine direction length in either the paper side or machine side of a fabric.

Knuckle: a locus in a woven fabric at which at least one yarn in a first direction passes around, and partially wraps about, a yarn in a transverse direction as a result of the weaving process.

Machine Direction (MD): a direction parallel to direction of movement of the web through the papermaking machine.

Machine Side (MS): the planar surface of a fabric opposite the paper side and in contact with the stationary elements of the papermaking machine.

Mesh: the number of warp yarns per unit CD width of fabric in either the PS or MS.

Paper Side (PS): the planar surface of a fabric on which the web is formed (also referred to as the sheet support surface).

Plain Weave: a weave pattern where each of the warp and well yarns pass in sequence, over one yarn and under one yarn.

Single Combined Path: the continuous path formed by the interweaving of intrinsic binder yarn pairs on a surface (typically the PS) of a fabric in a manner such that the yarns of the pair alternate with each other to appear in turn in the PS and MS layers, to complete together the chosen weave pattern.

Triple Layer Fabric: a forming fabric having two separate layers including weft yarns of three differing sizes—small yarns on the paper side layer, larger yarns on the machine side layer, and binder yarns, typically fine in size, interwoven between the layers to unite them.

Warp: yarns paid off a back beam in a loom and which, in flat woven fabrics, are oriented in the machine direction or length of the fabric.

Warp Yarn Path Ratio: the ratio of the number of single combined paths on the paper side of the fabric to the number of single warp yarns on the machine side of the fabric. In the fabrics of the present invention, there will be at least three warp yarns for every two single combined paths (1.5:1 ratio).

Weft: filling or "shute" yarns inserted across the width of a flat woven fabric and interwoven with the warp yarns.

In modern papermaking processes, as would be found for example in a twin wire gap or hybrid forming section, a highly aqueous stock comprising about 99% water and 1% papermaking solids is ejected from a headbox slice onto a moving forming fabric. The stock jet impinges the fabric over an impingement or forming shoe and is thereafter sandwiched by a second fabric and conveyed over various fabric support elements including blades and foils so as to agitate the stock and provide good sheet formation in the final paper product. This agitation is necessary in order to randomize the distribution and orientation of the papermaking fibers which, as has been established by measurement, on leaving the headbox and approaching the forming fabric prior to drainage are primarily aligned in the machine direction (MD). Agitation is also provided to avoid agglomeration of the fibers as flocs in the paper sheet.

Paper products evidencing uniform sheet formation are generally preferred for printing and like applications due to their more even ink absorption qualities and other properties such as the ratio of MD/CD (machine direction to cross-machine direction) tensile strength. Other desirable physical properties of the paper product are also enhanced when sheet formation is uniform. The nascent paper web is delivered from the forming section with a fiber to water percentage ratio of about 25/75 to the press section where further water removal occurs by mechanical means. The web is conveyed on a series of press fabrics through several press nips where a portion of the water is removed into the fabrics by pressure. As it exits the press section, the now somewhat consolidated sheet will consist of about 45% fiber and 55% water. It is then passed into the dryer section where the remaining water is removed by evaporative means as the sheet is exposed to heat sources, for example by being conveyed in a serpentine manner over numerous heated dryer cylinders while supported on a series of dryer fabrics. As it exits the dryer section to be wound onto reels, the sheet will consist of about 97-99% papermaking fibers and about 1-3% water.

The purpose of the forming fabric is to allow the water in the papermaking stock to drain through openings in the fabric while retaining the cellulosic fibers on the paper side (PS) surface to consolidate and become the embryonic sheet that will be passed into the downstream press section for further water removal. Virgin papermaking fibers intended for printing, newsprint and similar grades of paper generally have fiber lengths in the order of from about 1-3 mm depending on their source (i.e. softwood or hardwood). Increasingly greater amounts of fiber are now being derived from recycle sources where newsprint, cardboard and similar paper products are re-pulped and the fibers thus obtained are either mixed with a quantity of virgin fiber or supplied directly to the papermaking process. The re-pulping process tends to break the fibers and shorten them. With the increasing use of recycled stock, together with the use of fillers, it becomes proportionately more difficult to support and retain the shortened fibers on the PS of the fabric due to the size of the frame openings in the PS of the forming fabric. This problem is exacerbated by the fact that, as noted above, as the stock jet impinges the forming fabric, the papermaking fibers tend to be predominantly MD oriented. Depending on fabric design, the frame openings in the fabric may be square (e.g. in a plain weave over/under design) or they may be rectangular with the long side of the opening oriented in either the MD or the CD. It is well known in the industry that forming fabrics woven to provide either a plain weave PS surface, or one with rectangular openings oriented in the CD will provide better support for the fibers than fabrics with MD oriented rectangular openings.

Experiments by Robert Beran (TAPPI J., Vol. 62, no. 4 (April 1979), pp. 39-44) demonstrated that CD oriented fiber support as provided by the forming fabric yarns is more important for desirable papermaking than is MD support. Beran's Fiber Support Index (FSI) formula, which was developed as a result of his experiments, gives a weighting of 2:1 in favour of the CD yarn support over MD yarn support to optimize paper properties. This empirical relationship has been successfully applied by the paper industry for many years and is as follows:

$$FSI = \left(\frac{\pi}{2}\right)\left(\frac{Z}{\lambda}\right) = \left(\frac{2}{3}\right)(aN_m + 2bN_c)$$

Where $\lambda$=mean fiber length $N_m$=number of MD yarns/inch $N_c$=number of CD yarns/inch a,b=coefficients for contribution of support from MD and CD yarns, respectively (a function of weave pattern and running orientation)

Z=average number of supports per fiber.

In addition to providing a high degree of support for the papermaking fibers, drainage must occur in order to provide a somewhat consolidated fiber mat on the forming fabric surface which can then be transferred to the press section for further dewatering. With machine speed increases, this drainage through the forming fabric has to occur much faster than was previously the case. The area in the PS surface of the forming fabric which is available for drainage is referred to as drainage area. The drainage area is essentially a plan view of the open areas in between the mesh of the interwoven yarns through which fluid drains and is usually expressed as a percentage of the PS surface area.

The smaller the drainage area, the higher the differential pressure which is required to obtain the same volume of fluid in a given distance, i.e. if the differential pressure is not increased, a lower volume of fluid will be drained. This differential pressure is provided by drainage elements (e.g. foil blades, suction boxes, etc.) located beneath and in contact with the MS of the fabric. As the speed of the paper machine increases, it will be necessary to increase the differential pressure so as to maintain drainage; if this cannot be done effectively, then machine speed will have to be reduced to a point where adequate drainage of fluid from the sheet is obtained. Thus, fluid drainage through the forming fabric will impact and limit the speed at which paper can be made.

The drainage area of a fabric is calculated using the MD space between CD yarns and the CD space between the MD yarns. Beran's experiments showed that CD support is very important for paper properties as this is the span between the CD yarns which support the predominantly MD oriented fibers in the stock. Although the MD spacing between the CD yarns also plays an important role, the MD spacing between CD yarns is more important for papermaking properties.

The MD space between CD yarns is known as the frame length. With the decrease in papermaking fiber lengths in the stock due to the increased recycle content, it is advantageous for fiber support to reduce the frame length so far as possible, without adversely affecting other properties of the fabric. However, any reduction in the frame length will close up the drainage area unless the CD space between the MD yarns is correspondingly increased.

It is well known that a forming fabric woven at a relatively high mesh and knocking, using very small thermoplastic monofilament yarns in both the MD (warp) and CD (weft) can provide a very fine, smooth papermaking surface with the smallest holes possible. Monofilament yarn sizes in the range of about 0.10 mm to about 0.15 mm diameter are currently being used to weave the PS of some forming fabrics. These very small yarns enable the manufacturer to minimize the size of the frame openings in the fabric to the greatest extent possible. However, at papermaking speeds in excess of 1000 m/min, the stability of these finely woven textiles may become problematic. It is also difficult to provide a strong and reliable woven seam that will not fail under the high tensile loads imposed on the fabric. Still further, it is also very time consuming and expensive to produce fabrics with very small frame openings due to the required high knocking.

In conventional weaving of e.g. triple layer forming fabrics with a plain weave design on the PS, the MD and CD yarns are located in, and stay, in the same plane. Experience has shown that, during weaving, there are physical limitations as to how many CD (weft) yarns can be inserted into the plane before it becomes overcrowded. Over-crowding occurs when the total size of the warp and weft yarns is greater than the space that is available to accommodate them. In manufacturing terms, this is known as the crowd factor; a 100% crowd factor is reached when there is physically no more room for additional warp or weft yarns in a given space in the fabric. If additional yarns are forced into the fabric during weaving, either the yarns or the weave pattern will become distorted, which is undesirable.

Manufacturers of papermakers' forming fabrics strive to minimize the MD frame length in their products so as to maximize fiber support. For example, fabrics constructed in accordance with the claims of U.S. Pat. No. 5,826,627 (Seabrook et al.) are often woven to provide a knocking of about 100 weft yarns per inch (39.4 weft yarns per cm) of fabric length on the PS so as to achieve a very fine but open papermaking surface that will provide adequate fiber support and drainage area. However, this is inefficient as a weft yarn must be "shot" across the fabric width each time one is inserted into the woven structure; the higher the PS knocking, the slower fabric production will be. Further, at high weft yarn densities such as these, a minimum frame length limit is reached because there must be sufficient room between each successive weft to accommodate a warp yarn that is interwoven around each weft. The only way to reduce frame length in fabrics woven in this manner is to reduce the diameter of either, or both, the warp and weft. However, a practical lower limit on these yarn sizes will be reached, by reason of the need to maintain certain minimum limits of physical fabric properties.

It is therefore desirable to achieve a fabric design which will efficiently allow for a high degree of CD support for the papermaking fibers while providing for as small a frame opening as possible and maximizing the available drainage area; which can be woven efficiently; which provides for both a stable textile product capable of running at modern papermaking speeds; and which can be reliably seamed.

Forming fabric constructions which utilize the warp yarns as intrinsic binder yarns pairs are known. US 2006/0048840 (Quigley) discloses a composite forming fabric having a top and a bottom weave and includes interchanging binder warp yarns arranged in groups of at least two wherein for each group of binder yarns, the number of bottom warp yarns only weaving the bottom weave is higher than the number of top warp yarns only weaving the top weave. The disclosure includes only one FIG. (1A-1C) which must be considered the sole embodiment. This Figure shows a fabric in which there are no top warp yarns only weaving the top weave, but there are bottom warp yarns (W3) weaving only the bottom weave. Therefore, for each group of binder yarns (B1, B2), the number of bottom warp only weaving the bottom weave is greater than the number of top warp yarns only weaving the top weave. The application does not disclose any fabric in which there are any warp yarns dedicated to the top weave, and only discloses a fabric in which there is one dedicated bottom warp yarn (W3) for each group of binder yarns (B1, B2).

In particular, it has been found advantageous to provide weave patterns in which the warp yarns used in the PS weave pattern are provided by only intrinsic binder yarn pairs, which are interwoven with selected MS weft yarns, and warp yarns dedicated to the MS layer only, i.e. which do not pass into the PS, are interwoven with certain of the same selected MS weft yarns, in the manner discussed further below, to create a stable platform for the PS weave. Where the ratio of the number of MS warp to the number of effective PS warp which form single combined paths is at least 1.5:1, and where relatively short MD frame lengths are provided in the PS, this results in maximizing fiber support while providing a high open area so as to maintain drainage of the sheet. It has further been found that, due to the unique construction of these fabrics, their CPR is very high, in the range of about 16% to 30%, which serves to reduce straight-through drainage of fluid through the fabric thereby resulting in excellent sheet formation properties.

In the fabrics of the present invention, there are at least two warp yarns dedicated to the MS and interweaving the bottom weave (or MS weft) for every pair of binder warp yarns, and each binder yarn interlaces with the MS weft at a location where at least one MS warp also interlaces with the same MS weft to form a knuckle. Where there are two dedicated MS warp yarns for each pair of binder warp yarns, and the MS warp yarns follow separate paths from each other, each of the dedicated MS warp yarns combines with each member of an intrinsic binder yarn pair in turn to form the knuckles in each repeat of the weave pattern. Thus, for a fabric where the MS weave pattern comprises single knuckles, a first MS warp yarn interlaces a first MS weft yarn together with a first member of an intrinsic binder yarn pair to form a first knuckle, and then interlaces a second MS weft yarn together with the second member of the same intrinsic binder yarn pair to form a second knuckle. Similarly, the next adjacent dedicated MS warp yarn will interlace with the MS weft yarns to form a series of knuckles in which the two members of the intrinsic binder yarn pair alternate in interlacing with the respective MS weft yarns, in each case together with the dedicated MS warp yarn.

Where the MS weave pattern provides for an over 1, under 1, over 1 interweaving of the dedicated MS warp yarns with three successive MS weft yarns, to form a double warp knuckle, the members of each intrinsic binder yarn pair can be woven such that the first member is woven together with the corresponding dedicated MS warp yarn for the complete double warp knuckle, and the second member is woven together with that MS warp yarn for the next adjacent double warp knuckle. Alternatively, each member of the pair can be included in each double warp knuckle, by a first member being woven together with the corresponding MS warp yarn in the first part of the double warp knuckle and the second member being woven together with that yarn in the second part of the same double warp knuckle.

In the fabrics of this invention, all of the PS warp yarns are arranged as intrinsic binder yarn pairs such that when one warp of the pair is interweaving with PS weft yarns, the second member of the pair is either passing through the center plane of the fabric, or is weaving with selected MS weft yarns; i.e. each intrinsic binder yarn pair interweaves with the PS weft to form a single combined path in the PS. That path is comprised of relatively shorter woven PS segments made by each pair member as they interweave in turn with the PS weft yarns. Between each PS woven segment, each warp yarn forms long floats which pass through the center plane of the fabric before the yarn forms one or more knuckles with selected weft yarns of the MS layer each of which, as discussed above, is also interwoven with one, or both, of the MS warp so as to unite the PS and MS layers together. These long floats help to relieve the crowding conditions of a continuous plain weave, discussed above, while allowing a greater number of CD yarns to be woven into the structure than would be otherwise possible, without overcrowding the PS layer. In addition, the retained crimp created in the warp yarns of the intrinsic binder yarn pairs by the interweaving of these yarns to form the floats and knuckles in the fabric constructions of this invention will provide for a high strength woven seam which can be narrower than that provided in similar fabrics that do not employ these binder yarn pairs. Because the single combined path is comprised of 2 yarns, each of which is laterally displaced in the CD relative to the other, the CD distance between MD knuckles in the PS surface is doubled in comparison to that provided in a comparable fabric which does not include intrinsic binder yarn pairs. This lateral displacement, in combination with the long interior yarn floats, provides more PS drainage area than would otherwise be possible, while decreasing the frame length to maintain a high degree of fiber support.

In particular, it has been found that by creating the MS woven structure using warp yarns that are dedicated to the MS layer only and do not pass into the PS, a very fine woven structure can be provided on the PS, which structure alone would not be sufficiently rugged to withstand the forces to which such a fabric would be exposed in a modern high speed papermaking environment. The MS layer is comprised of MS weft interwoven with sets of 2 MS warp yarns which remain in the MS layer and cooperate together to form the weave pattern of the MS layer (i.e. one yarn replaces the other to complete the MS weave pattern). These MS warp yarns do not function as binder yarns to tie the MS and PS layers of the fabric together. Unlike the fabrics disclosed in EP 1630283 (Quigley) or U.S. Pat. No. 6,202,705 (Johnson et al.) or U.S. Pat. No. 6,581,645 (Johnson et al.), all of which disclose the use of single dedicated MS warp yarns in intrinsic binder yarn pair fabric constructions, the fabrics of the present invention employ sets of two MS warp yarns to increase the dimensional stability and provide a stable "platform" upon which the very fine PS layer is mounted, and at the same time increase the CPR, by reducing the open area available for drainage in the center plane. The ratio of the number of MS warp yarns in the fabric to the number of single combined paths in the PS is at least 1.5:1, taking the paths of the intrinsic binder yarn pairs to be effectively a single path. It has further been found to be particularly advantageous in the weave patterns of the invention for the dedicated MS warp yarns to interweave with the MS weft only at selected locations where one of the two warp yarns from the intrinsic binder yarn pairs interweave with the same selected MS weft, either in single or double warp knuckles, as discussed above.

This novel warp yarn arrangement allows for the formation of CD oriented rectangular openings in the PS of the fabric to increase papermaking fiber support, while the higher MS:PS warp ratio tends to close up the center plane and MS surface of the fabrics, thus retarding drainage and providing improvements in paper formation. The MS warp yarns are interwoven only with the MS well yarns to provide a rugged and stable platform to which the relatively fine PS surface is attached.

The invention therefore seeks to provide an industrial woven fabric for filtration in formation of a fibrous cellulosic sheet, the fabric having a sheet side layer with a sheet side surface and a machine side layer with a machine side surface, the fabric being woven to an overall repeating weave pattern and comprising (i) sheet side layer well yarns;

(ii) machine side layer well yarns;

(iii) a first set of warp yarns comprising only intrinsic binder yarn pairs; and (iv) a second set of warp yarns comprising machine side layer warp yarns, contributing only to the machine side layer and interwoven only with the machine side weft yarns, wherein (a) for each intrinsic binder yarn pair, the first and second members follow complementary identical paths in which the two members alternate with each other to appear in turn in the sheet side layer and the machine side layer and cooperate to define a single combined path in each of the sheet side layer and the machine side layer;

(b) at each location at which a member of an intrinsic binder yarn pair interweaves with a machine side layer weft yarn to form a knuckle, at least one of the machine side layer warp yarns interweaves with the same machine side layer weft yarn in the same knuckle; and (c) a warp yarn path ratio of numbers of machine side layer warp yarns to single combined paths of the intrinsic binder yarn pairs is at least 1.5:1.

The invention further seeks to provide an industrial woven fabric for filtration in formation of a fibrous cellulosic sheet, the fabric having a sheet side layer with a sheet side surface and a machine side layer with a machine side surface, the fabric being woven to an overall repeating weave pattern and comprising (i) sheet side layer weft yarns;

(ii) machine side layer weft yarns;

(iii) a first set of warp yarns comprising only intrinsic binder yarn pairs; and (iv) a second set of warp yarns comprising machine side layer warp yarns, contributing only to the machine side layer and interwoven only with the machine side weft yarns, wherein (a) for each intrinsic binder yarn pair, the first and second members follow complementary identical paths in which the two members alternate with each other to appear in turn in the sheet side layer and the machine side layer and cooperate to define a single combined path in each of the sheet side layer and the machine side layer, such that in the machine side layer, each member of the pair interweaves in sequence with two of the machine side layer weft yarns together with a first member of a pair of adjacent ones of the machine side layer warp yarns at a first interweaving point, and together with a second member of the pair of adjacent ones of the machine side layer warp yarns at a second interweaving point; and (b) a warp yarn path ratio of numbers of machine side layer warp yarns to single combined paths of the intrinsic binder yarn pairs is at least 1.5:1.

Preferably, the fabric is a papermakers' fabric, the fibrous cellulosic sheet is a paper sheet, the sheet side layer is a paper side layer with a paper side surface, and the sheet side well yarns are paper side well yarns.

As discussed further below, preferably the fabric has a fiber support index calculated pursuant to Beran's Fiber Support Index of at least 100, more preferably of at least 140, and most preferably of at least 150.

Preferably, the sheet side surface has a drainage area of less than 45%, more preferably between 30% and 40%, and most preferably between 30% and 35%.

Preferably, the fabric has a frame count of between 3000/in$^2$ and 6000/in$^2$ (465/cm$^2$ and 930/cm$^2$). The number of frames provided per unit area will be dependent on the intended end use of the fabric and may be between 3300/in$^2$ (511.5/cm$^2$) and 4500/in$^2$ (697.5/cm$^2$). However, frame counts higher or lower than the preferred range are certainly possible.

Preferably, the sheet side surface comprises frames having a greater dimension in the CD than in the MD of the fabric. Preferably also, the frame length is less than 0.25 mm, more preferably less than 0.2 mm, more preferably less than 0.15 mm, and most preferably less than 0.1 mm.

Preferably, each MS warp yarn has a cross-sectional area which is substantially equal to, and more preferably greater than, a cross-sectional area of each warp yarn of an intrinsic binder yarn pair.

Preferably, the warp yarns of the first set (the intrinsic binder yarn pairs) each have a substantially circular cross-section and a diameter of between 0.08 mm and 0.25 mm, more preferably a diameter of 0.1 and 0.13 mm. Preferably, each MS weft yarn has a cross-sectional area which is substantially equal to, and more preferably greater than, a cross-sectional area of each PS weft yarn.

The yarns of each of the sets, i.e. the first set of warp yarns, the second set of warp yarns, the PS weft yarns and the MS weft yarns can suitably have a cross-sectional configuration selected from circular, ovate, elliptical, rectangular and square.

Preferably, the MS warp yarns each have a substantially circular cross-section and a diameter of between 0.08 mm and 0.3 mm; the PS weft yarns each have a substantially circular cross-section and a diameter of between 0.08 mm and 0.3 mm; and the MS weft yarns each have a substantially circular cross-section and a diameter of between 0.1 mm and 0.5 mm.

Preferably, the warp yarns employed in any of the first set and the second set are monofilaments formed from a polymer selected from: polyethylene terephthalate (PET), polyethylene naphthalate (PEN), and a blend of PET and PEN; other polymers employed in the formation of monofilaments intended for use in industrial textiles such as papermaker's forming fabrics may also be suitable depending on the end use requirements of the textiles.

Preferably, the weft yarns are also monofilaments and are formed of a polymer including: a polyamide or co-polyamide, a polyester selected from polybutylene terephthalate (PBT), polytrimethylene terephthalate (PTT), PET, or a blend of PET and polyurethane such as is described in U.S. Pat. No. 5,169,711 or U.S. Pat. No. 5,502,120. When the chosen material is a polyamide, it is preferably selected from polyamide-6, polyamide-6/6, polyamide-6/10, polyamide 11, polyamide 12 and polyamide-6/12 or blends or copolymers thereof.

Preferably, the fabric has a drainage area in the center plane between the sheet side layer and the machine side layer of less than 40%, more preferably less than 30%, and most preferably less than 20%.

The fabrics of the invention can be woven using a loom equipped with either two or three warp beams, and according to an overall weave pattern requiring from 8, 12, 16 and 24 sheds in the loom (shed number). Two beams will be most suitable and are hence generally preferable. When the path lengths of one of the cooperating warp yarns in either the MS or PS differ, then a three beam loom will be required to accommodate the differing lengths.

Preferably, the single combined path of each pair of the intrinsic binder yarns comprises two segments separated by yarn exchange points, and the number of MS well yarns beneath each adjacent pair of yarn exchange points in one repeat of the overall fabric weave pattern is equal; alternatively, the number of MS weft yarns beneath each adjacent pair of yarn exchange points in one repeat of the overall fabric weave pattern is unequal. If this is done, then the fabric must be woven using a loom equipped with 3 warp beams so as to accommodate the various path lengths of the warp yarns.

In general, the weave designs chosen for each of the paper side layer and the machine side layer can be selected from various weave patterns known in the art. Preferably, the PS weave design is selected from the group consisting of a plain weave, a 2/1 twill, a 2/1 satin, a 3/1 twill, a 3/1 satin, and a design selected from known 2×2, 3×3, 3×6 and 4×8 patterns; preferably the weave design of the PS is a plain weave. The MS weave design can be selected from any of a group of well known designs including a plain weave, a twill and a satin weave; more preferably the design is selected from a 3×3, 4×4, 5×5, 6×6 and 6×12 design; most preferably it is selected from a 3×3 twill, a 6-shed broken twill, a 9×9 twill or an N×2N design in which N is the number of warp yarns and 2N is the number of well yarns in one repeat of the overall weave pattern.

The fabrics of the invention have a Fiber Support Index (FSI) value, calculated pursuant to Beran's Fiber Support Index, of at least 100 and preferably up to at least 150, most preferably between 150 and 175. The paper side drainage area is less than 45%, preferably 30% to 45%, most preferably 30% to 32%. The fabrics of the invention have a Center Plane Resistance in a notional central plane between the paper side layer and the machine side layer of less than 40%, preferably less than 30%, most preferably less than 20%.

Examples of the fabrics of the invention were woven, and compared with a control fabric woven according to U.S. Pat. No. 5,826,627 to Seabrook et al. (identified in Table 1 below as "Control"), and a similar fabric having an increased weft yarn count (Fabric 2 in Table 1). Fabrics 3 and 4 in Table 1 are two fabrics of the invention, as discussed further below.

Table 1:

In this Table, the various values for the features listed are stated in the units which are currently used in the industry as standard. However, applicable conversions are provided in relation to each of the features discussed in more detail in the text which follows the Table.

TABLE 1

| Fabric I.D. | Control | Fabric 2 | Fabric 3 | Fabric 4 |
|---|---|---|---|---|
| Fabric Construction | U.S. Pat. No. 5,826,627 | U.S. Pat. No. 5,826,627 | Invention | Invention |
| PS Weave | Plain Weave | Plain Weave | Plain Weave | Plain Weave |

TABLE 1-continued

| Fabric I.D. | Control | Fabric 2 | Fabric 3 | Fabric 4 |
|---|---|---|---|---|
| Yarn Count (1/in.) | | | | |
| Paper Side MD × CMD | 74 × 90 | 74 × 110 | 37 × 90 | 37 × 110 |
| Yarn Diameters (mm) | | | | |
| PS/MD | 0.13 | 0.13 | 0.13 | 0.13 |
| PS/CD | 0.14 | 0.14 | 0.14 | 0.14 |
| Surface Characteristics | | | | |
| Drainage Area | 31.3% | 24.5% | 40.9% | 31.9% |
| Frame Count | 6660/in.$^2$ | 8140/in.$^2$ | 3330/in.$^2$ | 4070/in.$^2$ |
| Fibre Support Index (F.S.I.) | 169 | 196 | 145 | 171 |
| Frame Length | 0.142 mm | 0.091 mm | 0.142 mm | 0.091 mm |
| Frame Openings | | | | |
| Frame Count/sq inch | 6660/in.$^2$ | 8140/in.$^2$ | 3330/in.$^2$ | 4070/in.$^2$ |
| Frame Length (mm) | 0.142 | 0.091 | 0.142 | 0.091 |
| Frame Width (mm) | 0.213 | 0.213 | 0.556 | 0.556 |
| Frame Area (mm$^2$) | 0.030 | 0.019 | 0.079 | 0.051 |

The PS weave of the Control fabric was a conventional plain weave; the yarn count in the PS surface was 74×90 (warp×weft) per inch (29.13×35.43 per cm). The PS warp yarn diameter was 0.13 mm and the PS weft yarn diameter was 0.14 mm. The PS drainage area was 31.3%, the frame count per square inch was 6660/in$^2$ (1032.3/cm$^2$) the FSI was 169 and the maximum MD frame length was 0.142 mm.

Fabric 2—In this sample the fabric was woven as a plain weave according to the same design and using the same yarn diameters as the Control fabric. However, in this case the CD well count was increased to 110/in. (43.3/cm) in order to give greater CD support to the MD oriented fibers. This had the desired effect of reducing the frame length to 0.091 mm and increasing the FSI up to 196, while increasing the frame count to 8140/in$^2$ (1261.7/cm$^2$). However, the drainage area of the PS was reduced from 31.3% to 24.5% (a 21.7% reduction). This considerable reduction in drainage area would reduce the volume of water drained through a fabric, if the same differential pressure was maintained.

Fabric 3—In this fabric of the invention, which is discussed further below in relation to the drawings, all the warps appearing in the PS were intrinsic binder yarn pairs, reducing by one-half the number of MD knuckles on the plain weave surface as the number of effective warp yarns is reduced from 74 to 37 by the use of the binder yarn pairs. The CD component of each frame opening was thereby increased to 0.556 mm from 0.213 mm, which increased the drainage area from 31.3% to 40.9% while using the same yarn diameters as in the Control fabric. The frame length of 0.142 mm was the same as in the Control fabric, but the frame count dropped down from 6660/in$^2$ (1032.3/cm$^2$) to 3330/in$^2$ (516.15/cm$^2$). The fewer MD yarns thus resulted in larger frames than in the Control fabric, but the FSI dropped from 169 to 145 because of the reduced MD support.

Fabric 4—In this second fabric of the invention, the more open structure of Fabric #3 was maintained, but the number of CD well yarns was increased to 110/in. (43.3/cm) as in Fabric #2 using the same diameter yarns as in that fabric. However, the use of intrinsic binder yarn pairs reduced the drainage area of Fabric #4 to 31.9% (similar to the Control fabric), but still much more open than Fabric #2 (at 24.5%). The maximum MD frame length was 0.091 mm (same as Fabric #2), but the FSI increased to 171 and the frame count rose to 4070/in$^2$ (630.85/cm$^2$) compared to 3330/in$^2$ (516.15/cm$^2$) for Fabric #3 and 6660/in$^2$ (1032.3/cm$^2$) for the Control fabric.

The data obtained from Fabric #4 clearly show that fabrics constructed using pairs of warp yarns arranged as intrinsic binder yarn pairs can provide a PS fabric surface having a high FSI value without sacrificing other important factors such as frame count and drainage area.

BRIEF DESCRIPTION OF THE DRAWINGS

The invention will now be described with reference to the drawings, in which.

DETAILED DESCRIPTION OF THE DRAWINGS

Referring to FIGS. 1, 3, 5, 7, 9 and 11, each of these shows a weave diagram of an embodiment of the invention; whereas each of FIGS. 2, 4, 6, 8, 10 and 12 show warp profiles corresponding to these six weave diagrams respectively.

Figure 5:
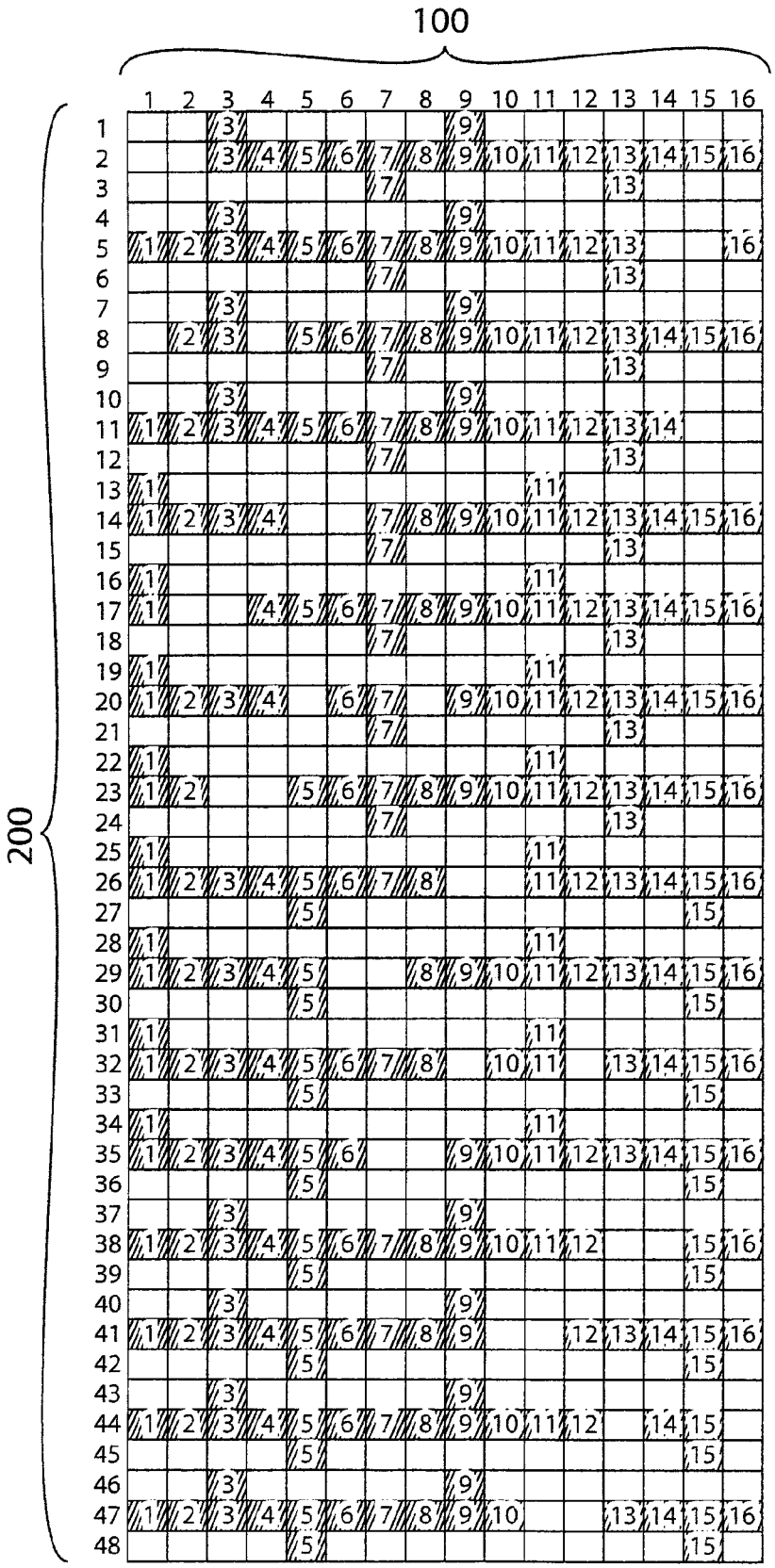
FIG. 5 is a weave diagram of an embodiment of the invention.
Figure 11:
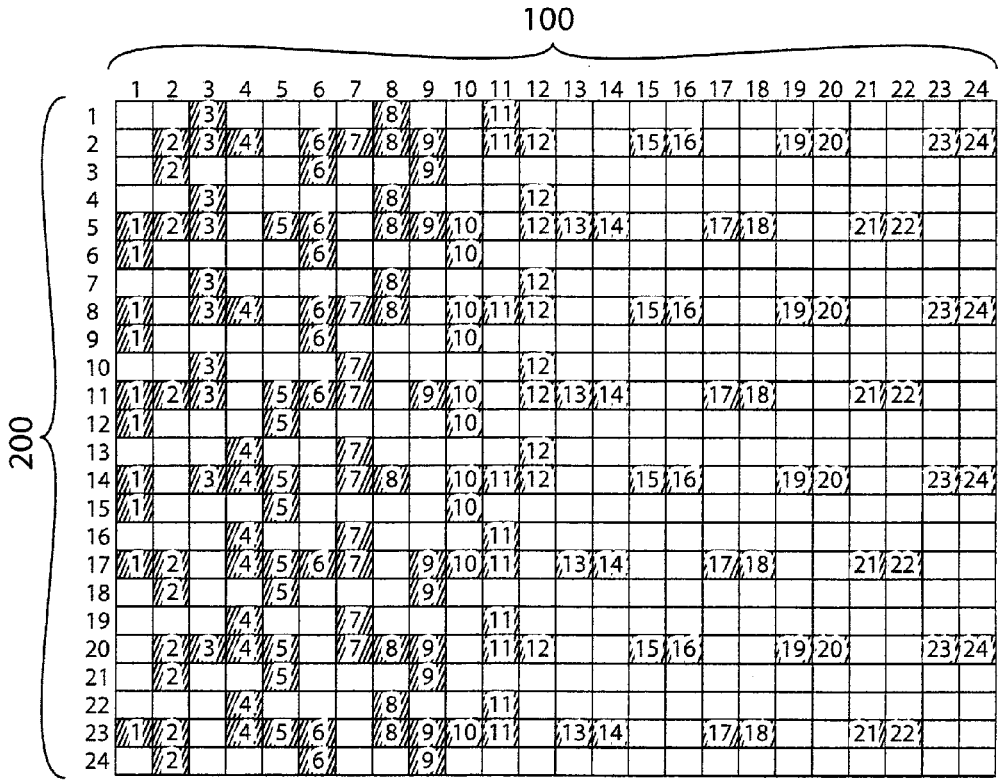
FIG. 11 is a weave diagram of an embodiment of the invention.

In each of these six weave diagrams, warp yarns 100 are shown running vertically on the page, numbered across the top of the diagram individually as 1 to 24 in each of the 24-shed patterns shown in FIGS. 1, 3, 7, 9 and 11, and as 1 to 16 in the 16-shed pattern shown in FIG. 5. The weft yarns 200, comprising PS wefts 210 and MS wefts 220, are shown running horizontally across the page, numbered down the left side of the diagram individually as 1 to 24 (FIG. 1), 1 to 36 (FIG. 3), 1 to 48 (FIG. 5), 1 to 36 (FIG. 7), 1 to 36 (FIG. 9) and 1 to 24 (FIG. 11).

Figure 1:
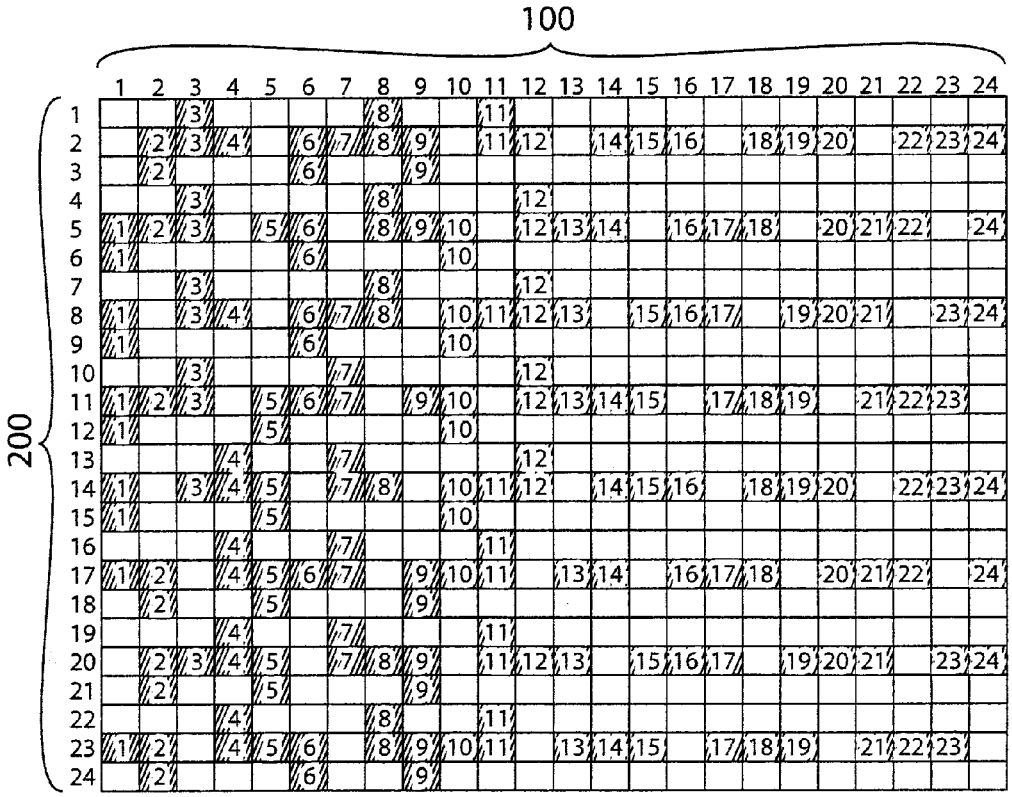
FIG. 1 is a weave diagram of an embodiment of the invention.
Figure 2:
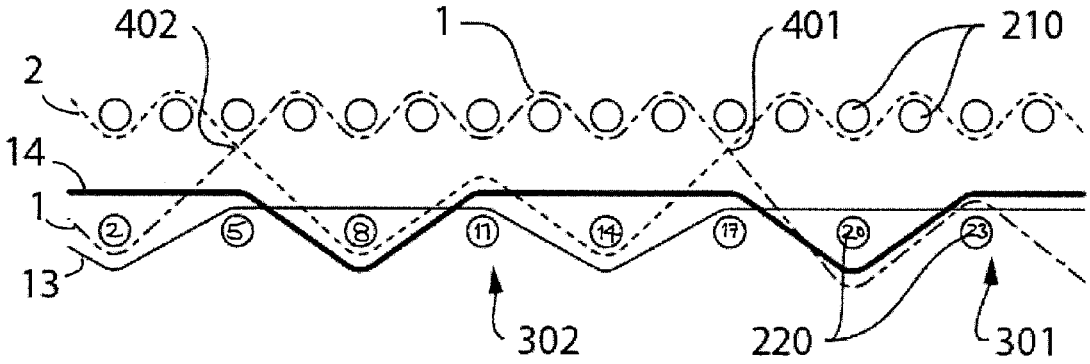
FIG. 2 is a cross-sectional view of the embodiment of FIG. 1, showing warp profiles of selected yarns.
Figure 3:
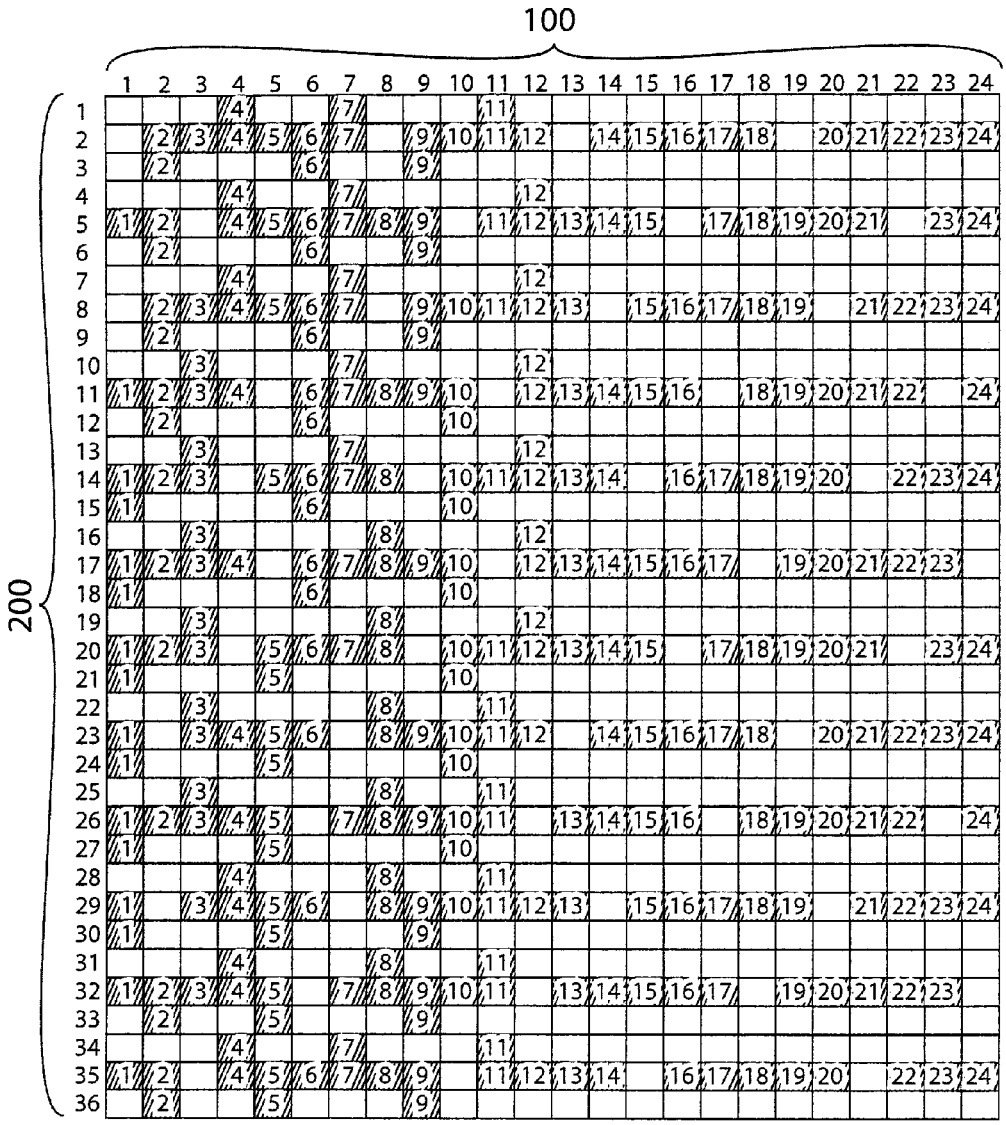
FIG. 3 is a weave diagram of an embodiment of the invention.
Figure 4:
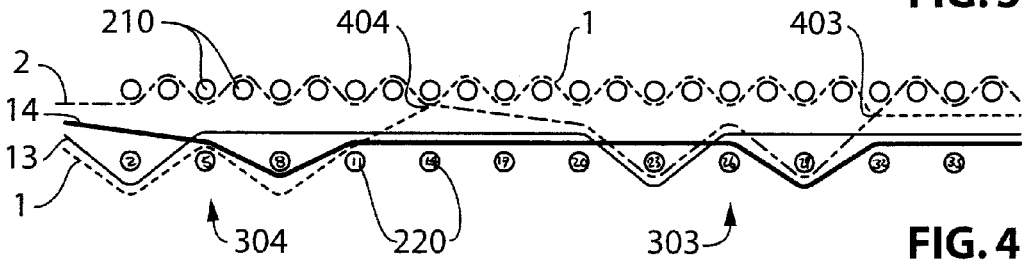
FIG. 4 is a cross-sectional view of the embodiment of FIG. 3, showing warp profiles of selected yarns.

Referring to FIG. 2, PS wefts 210 and MS wefts 220 are shown in cross-section, interwoven with intrinsic binder yarns 1 and 2, and dedicated MS warp yarns 13 and 14, in a 24 shed pattern. The MS wefts 220 are identified individually as wefts 2, 5, 8, 11, 14, 17, 20 and 23, corresponding with those numbered wefts in the weave diagram of FIG. 1. In a first segment, shown in the center of this figure as a complete segment, intrinsic binder yarn 1 interweaves with PS wefts 210 in a plain weave pattern, while intrinsic binder yarn 2 interweaves with the MS wefts 220 to form a double knuckle 302, together with first MS warp yarn 14 and then MS warp yarn 13. After intrinsic binder yarns 1 and 2 exchange positions at exchange point 401, in a second segment, shown at the right and left of the figure, intrinsic binder yarn 2 interweaves with PS wefts 210 in a continuation of the plain weave pattern, while intrinsic binder yarn 1 interweaves with the MS wefts 220 to form a double knuckle 301, together with first MS warp yarn 14 and then MS warp yarn 13. Thereafter, intrinsic binder yarns 1 and 2 again exchange positions at exchange point 402 to repeat the pattern.

Referring to FIG. 4, again PS wefts 210 and MS wefts 220 are shown in cross-section, interwoven with intrinsic binder yarns 1 and 2, and dedicated MS warp yarns 13 and 14, in a 24 shed pattern. The MS wefts 220 are identified individually as wefts 2, 5, 8, 11, 14, 17, 20, 23, 26, 29, 32 and 35, corresponding with those numbered wefts in the weave diagram of FIG. 3. In a first segment, shown in the center of this figure as a complete segment, intrinsic binder yarn 1 interweaves with PS wefts 210 in a plain weave pattern, in a longer run on the PS than in FIG. 2, while intrinsic binder yarn 2 is carried in the center plane, then interweaves with the MS wefts 220 to form a double knuckle 303, together with first MS warp yarn 13 and then MS warp yarn 14, after which intrinsic binder yarns 1 and 3 exchange positions at exchange point 403. Thereafter, in a second segment, shown at the right and left of the figure, intrinsic binder yarn 2 interweaves with PS wefts 210 in a continuation of the plain weave pattern, again in a longer run on the PS than in FIG. 2, while intrinsic binder yarn 1 is carried in the center plane, and then interweaves with the MS wefts 220 to form a double knuckle 304, together with first MS warp yarn 13 and then MS warp yarn 14, after which intrinsic binder yarns 1 and 2 again exchange positions at exchange point 404 to repeat the pattern.

Figure 6:
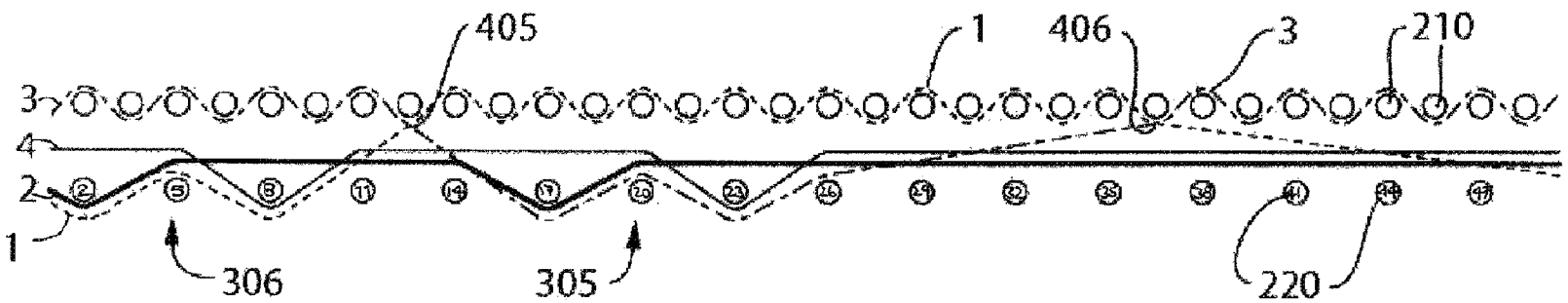
FIG. 6 is a cross-sectional view of the embodiment of FIG. 51, showing warp profiles of selected yarns.
Figure 7:
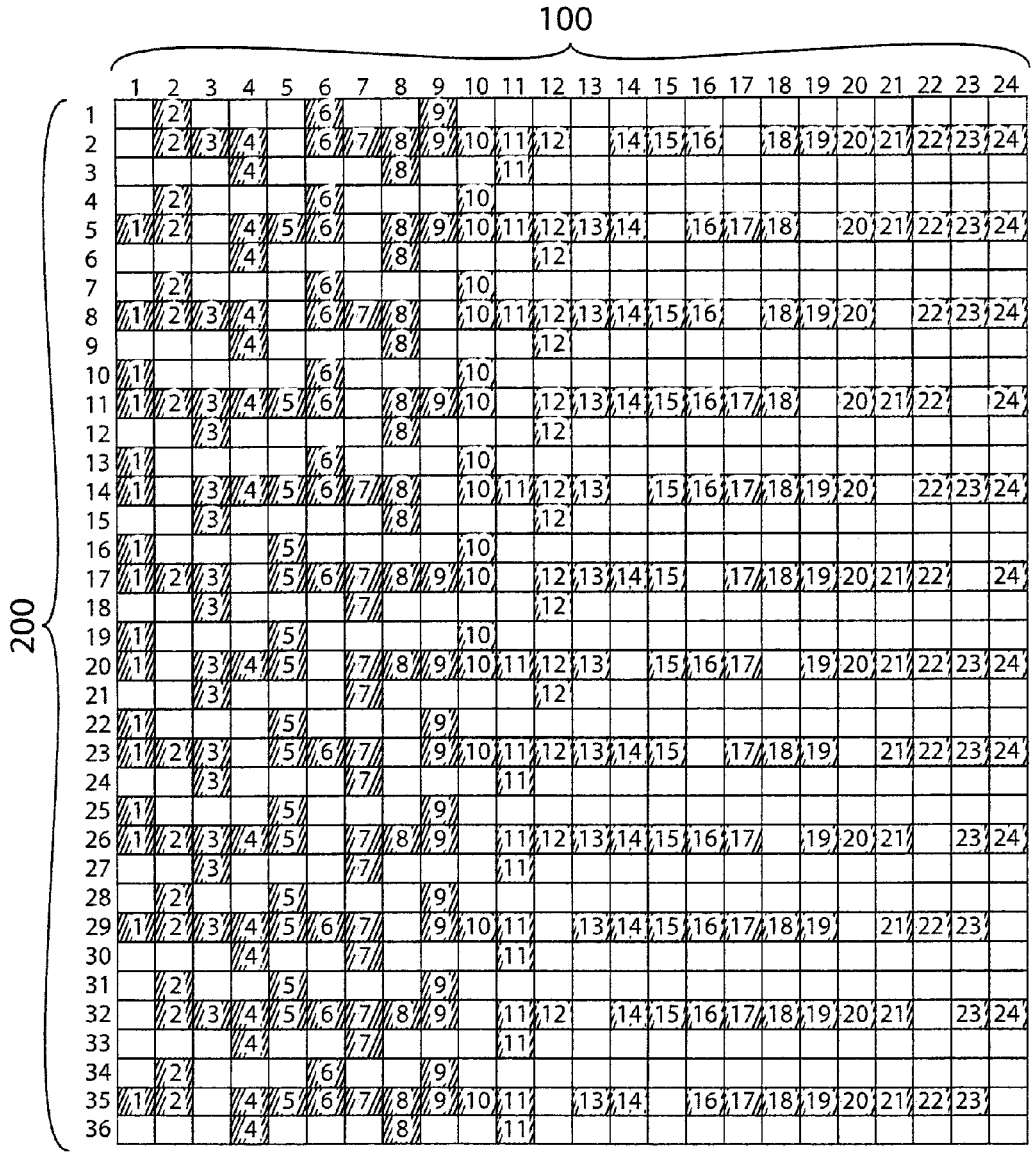
FIG. 7 is a weave diagram of an embodiment of the invention.

Referring to FIG. 6, PS wefts 210 and MS wefts 220 are shown in cross-section, interwoven with intrinsic binder yarns 1 and 3, and dedicated MS warp yarns 2 and 4, in a 16 shed pattern. The MS wefts 220 are identified individually as wefts 2, 5, 8, 11, 14, 17, 20, 23, 26, 29, 32, 35, 38, 41, 44 and 47, corresponding with those numbered wefts in the weave diagram of FIG. 5. In a first segment, shown in the center of this figure as a complete segment, intrinsic binder yarn 1 interweaves with PS wefts 210 in a plain weave pattern, while intrinsic binder yarn 3 interweaves with the MS wefts 220 to form a double knuckle 305, together with first MS warp yarn 2 and then with MS warp yarn 4, and then remains in the center plane before exchanging positions with intrinsic binder yarn 1 at exchange point 406. Thereafter, in a second segment, shown at the right and left of the figure, intrinsic binder yarn 3 interweaves with PS wefts 210 in a continuation of the plain weave pattern, while intrinsic binder yarn 1 is carried in the center plane and then interweaves with the MS wefts 220 to form a double knuckle 306, together with first MS warp yarn 2 and then MS warp yarn 4, until exchanging positions with intrinsic binder yarn 1 at exchange point 405 to repeat the pattern.

Figure 8:
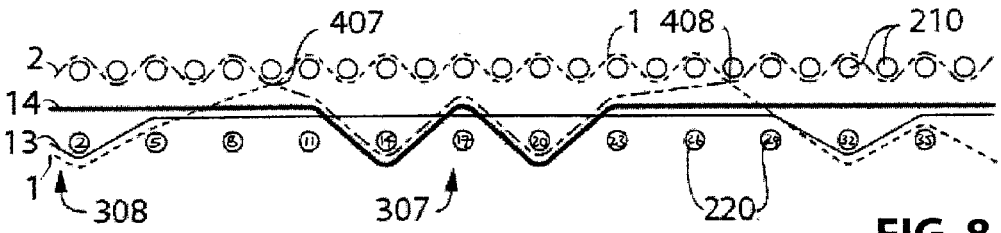
FIG. 8 is a cross-sectional view of the embodiment of FIG. 7, showing warp profiles of selected yarns.
Figure 9:
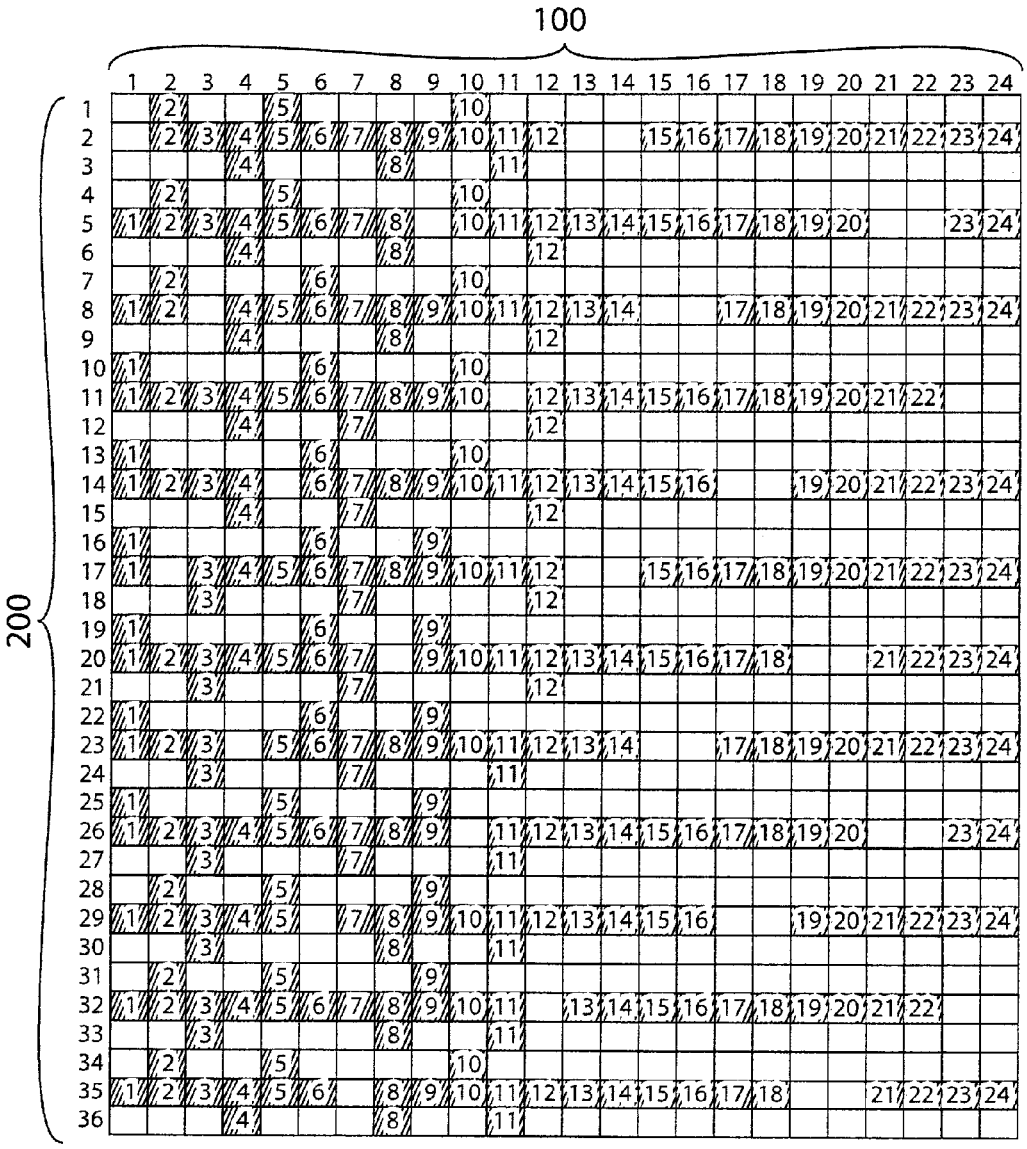
FIG. 9 is a weave diagram of an embodiment of the invention.

Referring to FIG. 8, PS wefts 210 and MS wefts 220 are shown cross-section, interwoven with intrinsic binder yarns 1 and 2, and dedicated MS warp yarns 13 and 14, in a 24 shed pattern. The MS wefts 220 are identified individually as wefts 2, 5, 8, 11, 14, 17, 20, 23, 26, 29, 32 and 35, corresponding with those numbered wefts in the weave diagram of FIG. 7. In a first segment, shown in the center of this figure as a complete segment, intrinsic binder yarn 1 interweaves with PS wefts 210 in a plain weave pattern, while intrinsic binder yarn 2 interweaves with the MS wefts 220 to form a double knuckle 307, together with MS warp yarn 14, and then remains in the center plane before exchanging positions with intrinsic binder yarn 1 at exchange point 408. Thereafter, in a second segment, shown at the right and left of the figure, intrinsic binder yarn 2 interweaves with PS wefts 210 in a continuation of the plain weave pattern, while intrinsic binder yarn 1 interweaves with the MS wefts 220 to form a double knuckle 308, together with MS warp yarn 13, and then remains in the center plane of the fabric until exchanging positions with intrinsic binder yarn 2 at exchange point 407.

Figure 10:
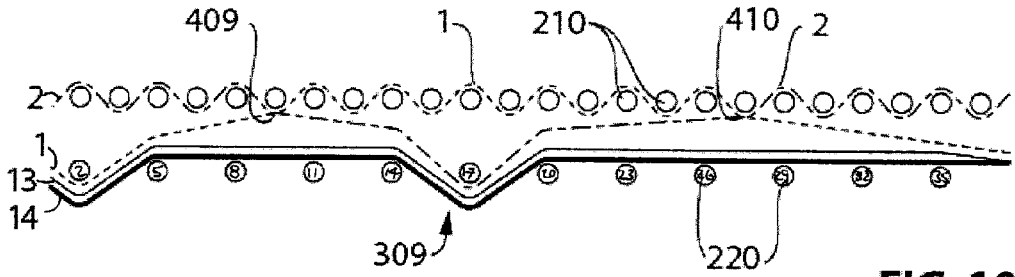
FIG. 10 is a cross-sectional view of the embodiment of FIG. 9, showing warp profiles of selected yarns.

Referring to FIG. 10, PS wefts 210 and MS wefts 220 are shown in cross-section, interwoven with intrinsic binder yarns 1 and 2, and dedicated MS warp yarns 13 and 14, in a 24 shed pattern. The MS wefts 220 are identified individually as wefts 2, 5, 8, 11, 14, 17, 20, 23, 26, 29, 32 and 35, corresponding with those numbered wefts in the weave diagram of FIG. 9. In this pattern, intrinsic binder yarns 1 and 2 alternate in providing a plain weave in the PS, and each interweaves with the MS wefts 220 at single knuckles 309, but together with both of MS warps 13 and 14, remaining in the center plane for long internal floats between the single knuckles 309 and each of the exchange points 409 and 410.

Figure 12:
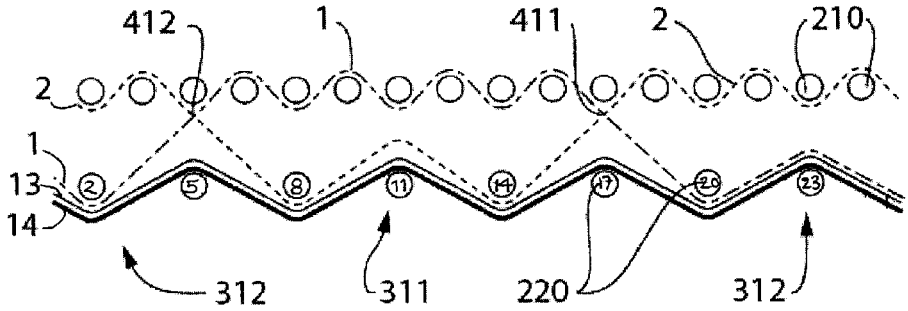
FIG. 12 is a cross-sectional view of the embodiment of FIG. 11, showing warp profiles of selected yarns.

Referring to FIG. 12, PS wefts 210 and MS wefts 220 are shown in cross-section, interwoven with intrinsic binder yarns 1 and 2, and dedicated MS warp yarns 13 and 14, in a 24 shed pattern. The MS wefts 220 are identified individually as wefts 2, 5, 8, 11, 14, 17, 20 and 23, corresponding with those numbered wefts in the weave diagram of FIG. 11. In this pattern, intrinsic binder yarns 1 and 2 alternate in providing a plain weave in the PS, and interweave with the MS wefts 220 at double knuckles 312, 311 respectively, but in each case together with both of MS warps 13 and 14. Between exchange points 412 and 411, intrinsic binder yarn 2, together with warp yarns 13 and 14, provides a plain weave in the MS; similarly, intrinsic binder yarn 1 continues the pattern with warp yarns 13 and 14 between exchange point 411 and the subsequent exchange point 412.

In the fabrics of the invention, as discussed above, the intrinsic binder yarns are provided as pairs, and in each case, in each repeat of the weave pattern, each of the yarns of the pair will in turn interweave with the sheet side weft yarns to contribute to the sheet side pattern, while the other yarn of the pair will in turn form an internal float in the center plane of the fabric, between the sheet side and machine side layers, and then interweave, together with dedicated MS warp yarns, with selected MS weft yarns. Thus each pair of intrinsic binder yarns will form a single combined warp path in the sheet side of the fabric, which when compared with the number of dedicated MS warp yarns in the same repeat of the overall weave pattern will identify the warp yarn path ratio, which for the fabrics of the invention is at least 1.5:1 (MS:PS ratio).

Further, in the fabrics of the invention, it can be seen from the figures that the segments, as identified above, and separated by the yarn exchange points of the intrinsic binder yarns, can be equal or unequal; thus the number of MS weft yarns between each adjacent pair of exchange points in one repeat of the overall fabric weave pattern can be equal or unequal, thus maximizing the options which can be selected for the MS weave patterns, such as MS weft float lengths, depending on the specific intended end use for the fabric.

In addition, due to the unique arrangement of both the intrinsic binder yarn pairs and the MS warp yarns, the fabrics of this invention exhibit advantageous CPR values, having an open area for drainage at least as low as 30%, and potentially as low as 20% or less. This indicates that these novel fabrics will have less straight-through drainage than comparable fabrics of the prior art which are not so constructed and which do not employ additional MS warp arranged in the manner disclosed herein, thus providing benefits to the papermaker in terms of improved sheet formation and uniformity.

The invention claimed is:

1. An industrial woven fabric for filtration in formation of a fibrous cellulosic sheet, the fabric having a sheet side layer with a sheet side surface and a machine side layer with a machine side surface, the fabric being woven to an overall repeating weave pattern and comprising (i) sheet side layer weft yarns;

(ii) machine side layer weft yarns;

(iii) a first set of warp yarns comprising only intrinsic binder yarn pairs; and (iv) a second set of warp yarns comprising machine side layer warp yarns, contributing only to the machine side layer and interwoven only with the machine side weft yarns, wherein (a) for each intrinsic binder yarn pair, the first and second members follow complementary identical paths in which the two members alternate with each other to appear in turn in the sheet side layer and the machine side layer and cooperate to define a single combined path in each of the sheet side layer and the machine side layer;

(b) in the machine side layer, each member of each intrinsic binder yarn pair follows a path in which either (A) for every pair, at each location at which a member of an intrinsic binder yarn pair interweaves with a machine side layer weft yarn to form a knuckle, at least one of the machine side layer warp yarns interweaves with the same machine side layer weft yarn in the same knuckle; or (B) for every pair, each member of the pair interweaves in sequence with two of the machine side layer weft yarns together with a first member of a pair of adjacent ones of the machine side layer warp yarns at a first interweaving point, and together with a second member of the pair of adjacent ones of the machine side layer warp yarns at a second interweaving point; and (c) a warp yarn path ratio of numbers of machine side layer warp yarns to single combined paths of the intrinsic binder yarn pairs is at least 1.5:1.

2. A fabric according to claim 1, wherein the fabric has a fiber support index calculated pursuant to Beran's Fiber Support Index of substantially between 100 and 150.

3. A fabric according to claim 1, wherein the sheet side surface has a drainage area of less than substantially 45%.

4. A fabric according to claim 1, having a frame count substantially between $3000/in^2$ and $6000/in^2$.

5. A fabric according to claim 1, wherein the sheet side surface comprises frames having a greater dimension in a cross-machine direction than in a machine direction of the fabric.

6. A fabric according to claim 5, wherein the frame dimension in the machine direction is less than substantially 0.25 mm.

7. A fabric according to claim 1, wherein each machine side layer warp yarn has a cross-sectional area which is at least equal to a cross-sectional area of each warp yarn of an intrinsic binder yarn pair.

8. A fabric according to claim 1, wherein each machine side layer weft yarn has a cross-sectional area which is greater than a cross-sectional area of each sheet side layer weft yarn.

9. A fabric according to claim 1, wherein the warp yarns of the first set and the warp yarns of the second set each have a substantially circular cross-section and a diameter of substantially between 0.08 mm and 0.3 mm.

10. A fabric according to claim 1, wherein each yarn of any of the first set of warp yarns, the second set of warp yarns, the sheet side weft yarns and the machine side weft yarns has a cross-sectional configuration selected from circular, ovate, elliptical, rectangular and square.

11. A fabric according to claim 1, wherein the fabric has a drainage area in a notional central plane between the sheet side layer and the machine side layer of less than 40%.

12. A fabric according to claim 1, wherein the sheet side weave design is selected from the group consisting of a plain weave, a 2/1 twill, a 2/1 satin, a 3/1 twill, a 3/1 satin, and a design selected from 2×2, 3×3, 3×6 and 4×8.

13. A fabric according to claim 1, wherein the MS weave design is selected from the group consisting of a 3×3 twill, a 6-shed broken twill, a 9×9 twill, and a design selected from a 3×3, a 4×4, a 5×5, a 6×6 and an N×2N design in which N is the number of warp yarns and 2N is the number of weft yarns in one repeat of the overall weave pattern.

14. A fabric according to claim 1, wherein the single combined path formed by each intrinsic binder yarn pair comprises two segments separated by yarn exchange points, and the number of MS weft yarns beneath each adjacent pair of yarn exchange points in one repeat of the overall fabric weave pattern is equal.

15. A fabric according to claim 1, wherein the single combined path formed by each intrinsic binder yarn pair comprises two segments separated by yarn exchange points, and the number of MS weft yarns beneath each adjacent pair of yarn exchange points in one repeat of the overall fabric weave pattern is unequal.

* * * * *